United States Patent [19]

Einspahr

[11] Patent Number: 4,898,194

[45] Date of Patent: Feb. 6, 1990

[54] HAIR TREATMENT DEVICE AND METHOD

[76] Inventor: Connie J. Einspahr, Rt. #1 Box #92, Roseland, Nebr. 68973

[21] Appl. No.: 120,965

[22] Filed: Nov. 16, 1987

[51] Int. Cl.[4] ..... A45D 6/00

[52] U.S. Cl. ..... 132/251; 132/212; 132/207

[58] Field of Search ..... 132/33 R, 39, 41 B, 132/40, 207, 245, 246, 248, 249, 250, 251, 253, 254, 255, 259, 260, 264, 212

[56] References Cited

U.S. PATENT DOCUMENTS

| | | | |
|---|---|---|---|
| 4,216,787 | 8/1980 | Moea | 132/39 |
| 4,381,791 | 5/1983 | Van Sickle | 132/253 |
| 4,403,621 | 9/1983 | Paradise | 132/250 |
| 4,635,655 | 1/1987 | Paradise | 132/250 |
| 4,644,965 | 2/1987 | Alexander | 132/40 |
| 4,732,169 | 3/1988 | Van Sickle | 132/248 |

*Primary Examiner*—Gene Mancene
*Assistant Examiner*—Adriene J. Lepiane
*Attorney, Agent, or Firm*—Jerry T. Kearns

[57] ABSTRACT

A hair treatment device consists of a thin flexible plastic strip provided with radiused ends and a row of apertures. In use, the strip is inserted under the bands of perm rods which are situated on the head of a user. The user's hair is wrapped around the perm rods and secured by the bands. By inserting the strip between the perm rod bands and the user's hair, the bands are lifted slightly from the hair. When permanent solution is applied to the hair, the hair tends to expand against the perm rod bands. The strip serves to release the tension of the bands from the hair, preventing the hair from breaking. The holes in the strip allow the permanent solution to freely penetrate to all areas of the hair.

8 Claims, 3 Drawing Sheets

FIG 2
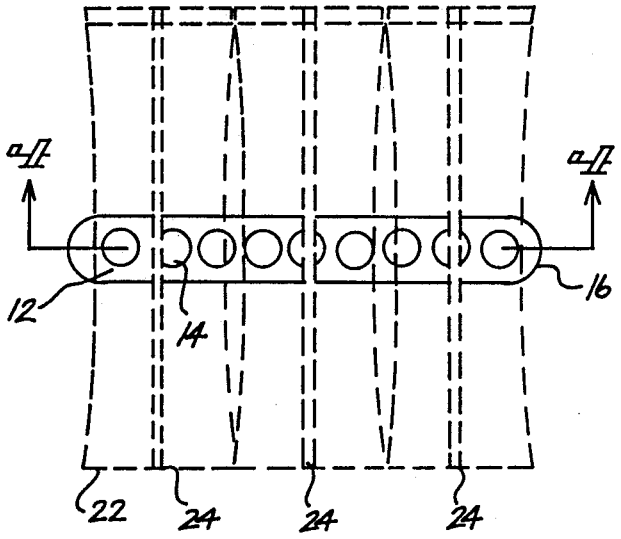
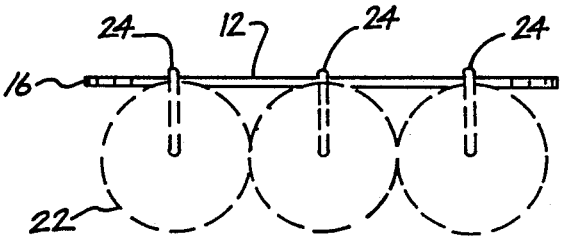
FIG 3
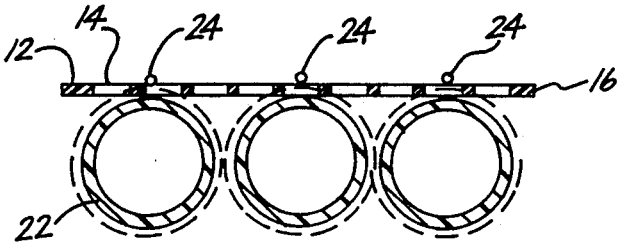
FIG 4

Fig 5
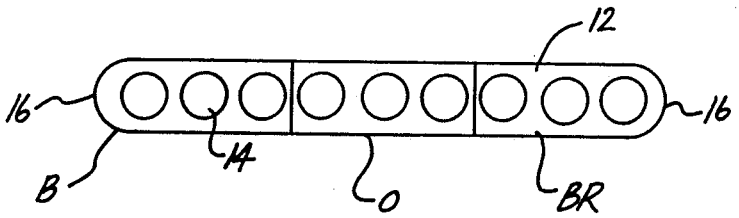
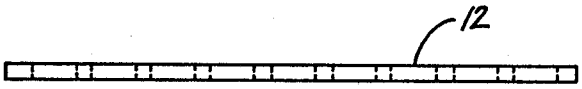
Fig 6
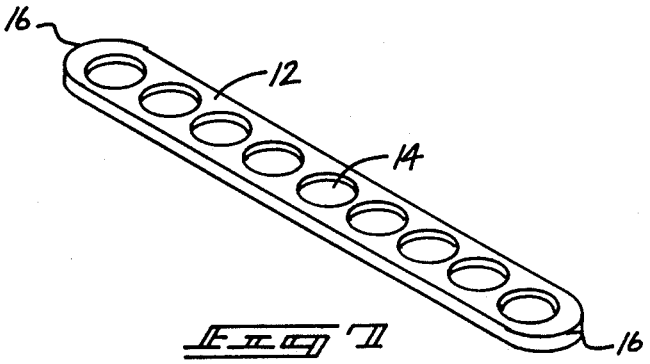
Fig 7

HAIR TREATMENT DEVICE AND METHOD

BACKGROUND OF THE INVENTION

1. Field of the Invention

The present invention relates to hair treatment devices, and more particularly pertains to a new and improved hair treatment device for preventing a person's hair from being broken by being pressed against the bands of a perm rod. When an individual is receiving a permanent treatment for their hair, their hair is curled around a plurality of perm rods and secured by bands. When the hair is treated with the permanent solution, this causes the hair to swell and expand, pressing the hair tightly against the bands. This causes some of the hair to break. In order to overcome this problem, the present invention provides a thin flexible plastic strip provided with a row of apertures for insertion between the curled hair and the bands on the perm rod. This spaces the band slightly from the hair, protecting the hair from breakage when the permanent solution is applied.

2. Description of the Prior Art

Various types of hair treatment devices are known in the prior art. A typical example of such a hair treatment device is to be found in U.S. Pat. No. 2,409,081, which issued to J. Torrens on Oct. 8, 1946. This patent discloses an ornamental cover for reception over a conventional hair curler. This device is constructed as a curved plastic shell provided with an array of apertures. An ornamental bow is formed on a top surface of the device. U.S. Pat. No. 2,659,378, which issued to V. Caserta on Nov. 17, 1953, discloses a pin curl clip. This device is constructed as a pair of overlying flat strips provided with a series of apertures. The strips are integrally formed and are connected by a resilient bight portion. This allows the device to securely hair of a user between the overlying strips. U.S. Pat. No. 3,050,071 which issued to R. Hall on Aug. 21, 1962, discloses a hair solution absorber formed from a generally H shaped tubular spongy material. This device is utilized to prevent excess permanent solution from dripping onto the face and neck of a person having their hair treated. U.S. Pat. No. 3,519,003, which issued to L. Mizell on July 7, 1970, discloses a device for depositing hair retaining filaments to the hair of a user. The device is designed for use in the place of conventional hair spray. U.S. Pat. No. 3,599,647, which issued to V. Fabbri on Aug. 17, 1971, discloses a hair treating device which is used to restrict the application of a treating composition such as dye or bleach to a selected predetermined pattern of the hair, while masking the remainder of hair from contact with the composition. U.S. Pat. No. 274,009, which issued to R. Caruso on May 29, 1984, discloses a hair clip formed from a generally cylindrical body portion provided with a series of apertures.

While the above mentioned devices are suited for their intended usage, none of these devices provide a hair treatment device for the prevention of hair breakage for use with conventional perm rods. Additionally, none of the aforesaid devices is suitable for insertion between the bands of perm rods and the hair of a user to prevent the hair from breaking against the bands. Inasmuch as the art is relatively crowded with respect to these various types of hair treatment devices, it can be appreciated that there is a continuing need for and interest in improvements to such hair treatment devices, and in this respect, the present invention addresses this need and interest.

SUMMARY OF THE INVENTION

In view of the foregoing disadvantages inherent in the known types of hair treatment devices now present in the prior art, the present invention provides an improved hair treatment device. As such, the general purpose of the present invention, which will be described subsequently in greater detail, is to provide a new and improved hair treatment device which has all the advantages of the prior art hair treatment devices and none of the disadvantages.

To attain this, a representative embodiment of the concepts of the present invention is illustrated in the drawings and makes use of a thin flexible plastic strip having rounded ends and provided with a series of apertures. The method of utilizing the device according to the present invention comprises the steps of rolling an individual's hair around conventional perm rods, securing the hair to the perm rods by conventional perm rod bands, inserting the thin flexible plastic strip between the bands of adjacent perm rods and the hair of the individual, and applying permanent solution to the hair and through the apertures in the strip. The strips serve to space the bands slightly from the hair, preventing the hair from being forced against the bands and breaking due to expansion of the hair upon treatment by the permanent solution.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved hair treatment device which has all the advantages of the prior art hair treatment devices and none of the disadvantages.

It is another object of the present invention to provide a new and improved hair treatment device which may be easily and efficiently manufactured and marketed.

It is a further object of the present invention to provide a new and improved hair treatment device which is of a durable and reliable construction.

An even further object of the present invention is to provide a new and improved hair treatment device which is susceptible of a low cost of manufacture with regard to both materials and labor, and which accordingly is then susceptible of low prices of sale to the consuming public, thereby making such hair treatment devices economically available to the buying public.

Still yet another object of the present invention is to provide a new and improved hair treatment device which provides in the apparatuses and methods of the prior art some of the advantages thereof, while simultaneously overcoming some of the disadvantages normally associated therewith.

Still another object of the present invention is to provide a new and improved hair treatment device for insertion between the bands of perm rods and the hair of an individual to prevent the hair from being forced against the bands and breaking upon expansion of the hair caused by treatment with a permanent solution.

Yet another object of the present invention is to provide a new and improved hair treatment device and method for treatment of an individual's hair which prevents breakage of the individual's hair upon treatment with a permanent solution.

Even still another object of the present invention is to provide a new and improved hair treatment device which includes a thin flexible plastic strip provided in various lengths for insertion between the bands of various sizes of perm rods in the hair of an individual.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 2 is a top view of the hair treatment device of the present invention in use with conventional perm rods and perm rod bands.

FIG. 3 is a side view of FIG. 2, illustrating the insertion of the hair treatment device of the present invention beneath the bands of adjacent perm rods.

FIG. 4 is a cross sectional view taken along line 4—4 of FIG. 2.

FIG. 5 is a top view of the hair treatment device of the present invention.

FIG. 6 is a side view of the hair treatment device of the present invention.

FIG. 7 is a perspective view of the hair treatment device of the present invention.

DESCRIPTION OF THE PREFERRED EMBODIMENT

Figure 1:
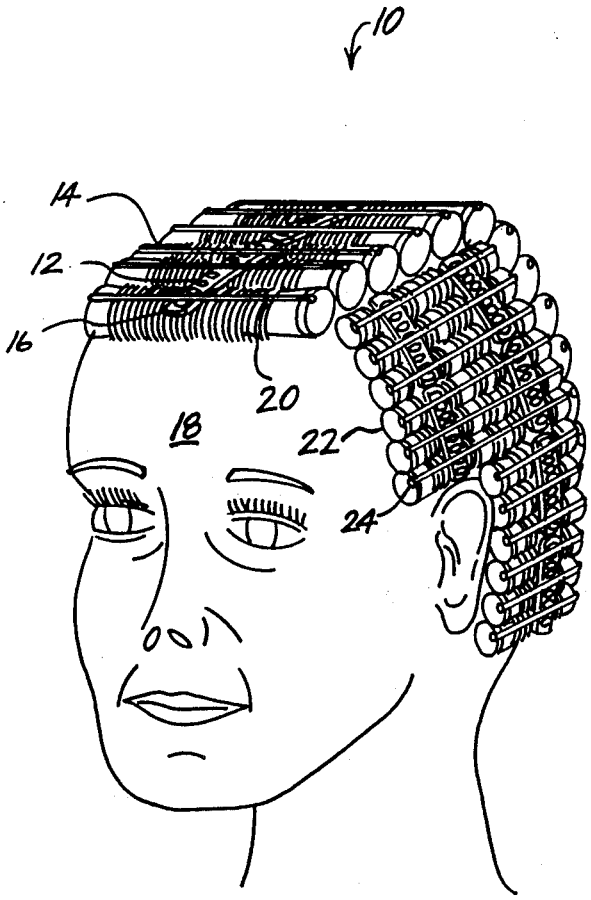
FIG. 1 is a perspective view of the head of an individual illustrating the manner of usage of the hair treatment device of the present invention.

With reference now to the drawings, and in particular to FIG. 1 thereof, a new and improved hair treatment device embodying the principles and concepts of the present invention and generally designated by the reference numeral 10 will be described.

More specifically, it will be noted that the first embodiment 10 of the invention includes a thin flexible plastic strip 12 provided with a row of circular apertures 14 and radiused ends 16. The strip 12 is inserted between the hair 20 on the head 18 of an individual and conventional perm rod attaching bands 24. The hair 20 is curled around the perm rods 22 in a conventional fashion. The perm rod bands 24 serve to secure the hair 20 against the perm rods 22. A permanent treatment solution is then applied to the hair 20 and also through the circular apertures 14 on the strip 12. This allows all portions of the hair to be evenly treated with the permanent solution. When the hair 20 is treated by a permanent solution, it will swell and expand. In the absence of the strips 12, the hair 20 will be forced against the perm rod bands 24, causing the hair to break. By insertion of the strips 12 between the bands 24 and perm rods 22, the bands 24 are spaced slightly from the hair 20, allowing the hair to expand upon treatment by the permanent solution, thus protecting the hair 20 from breakage. The strips 12 are formed from a flexible plastic, and are less than one sixteenth of an inch thick. The strips are preferably about one thirty second of an inch thick and one half inch in width. This allows the strips 12 to slightly lift the bands 24, while allowing the strips 12 to conform to the contour of the head 18 of the individual. The strips 12 will be provided in different lengths for use with the various different sizes of conventional perm rods. These conventional perm rods 22 are available in ten different sizes. The strips 12 are formed in three different sizes; two inch length, three inch length and three and a half inch length. This allows the strip 12 to be utilized with various different size perm rods. The larger perm rods are conventionally utilized on the top portion of the head 18 of the individual. The smaller perm rods are utilized on the sides and back of the individual's head 18, depending upon the desired results. The ten different conventional sizes of perm rods are color coded in the order from smallest to largest by the colors yellow, blue, pink, grey, white, green, purple, beige, orange and brown. In order to enable a beautician to quickly ascertain the correct length of strip 12 to utilize with each different size of perm rod 22, the various lengths of strips 12 are color coded to match the color of the corresponding perm rods 22. For example, the three smallest sized perm rods 22 have a standard color coding of yellow, blue, and pink. For use with these sizes of perm rods 22, it has been determined that a two inch length strip 12 is appropriate. This two inch length strip 12 will thus be colored yellow, blue, and pink. For the next four larger sizes of perm rods 22 color coded grey, white, green and purple, a three inch strip 12 is appropriate. This three inch strip 12 will be color coded grey, white, green and purple, corresponding to the colors of the appropriate perm rods. For the three standard largest sizes of perm rods 22, the standard color coding is beige, orange and brown. A three and one half inch length strip 12 is suitable for use with these three largest standard sizes of perm rods 22. The three and one half inch length strip 12 will thus be color coded beige, orange and brown. By the use of these color codes, the beautician may easily determine the correct size of strip 12 to be used with each size of perm rod.

With reference now to FIG. 2, a top diagrammatic view is provided, illustrating a strip 12 inserted beneath the bands 24 of three adjacent perm rods 22. The radiused ends of the strip 12 allow the strip to be easily inserted beneath the bands 24, without becoming entangled in the hair of the individual.

FIG. 3 depicts a side view of FIG. 2, illustrating the strip 12, disposed beneath the bands 24 of the three adjacent perm rods 22.

FIG. 4 illustrates a cross sectional view taken along line 4—4 of FIG. 2, illustrating the relative position of the apertures 14 in the strip 12.

In FIG. 5, a top view of an example strip 12 is provided. The strip is a three and one half inch length strip for usage with the three largest standard sizes of conventional perm rods. These three largest sizes of perm rods are color coded respectively beige, orange, and brown. Corresponding with this color coding, the strip 12 is provided with a first segment B which is colored beige. A middle segment 0 is colored orange and a third segment BR is color coded brown. This allows a beautician to ascertain at a glance, the correct size of strip 12 for use with the size of perm rod being employed.

FIG. 6 illustrates a side view of the strip 12. The strip has a thickness of less than one sixteenth of an inch, with a preferred thickness of approximately one thirty second of an inch. This allows the strip to slightly space the perm rod bands from an individual's hair, while allowing the strip to conform to the contours of the individual's head.

FIG. 7 illustrates a perspective view of a strip 12 according to the present invention.

With reference now to FIG. 1, the method of using the hair treating device 10 of the present invention will now be described. First, the hair 20 on the head of the individual 18 is curled in a conventional manner around a plurality of perm rods 22. Various different sizes of perm rods 22 are utilized on different areas of the individual's head 18. For each three adjacent perm rods 22, a strip 12 is inserted beneath the perm rod bands 24 and the hair 20 curled around the perm rods 22. This slightly spaces the bands 24 above the hair 20. The strips 12 are color coded, as previously described, and are selected in correspondence with the color coding of the perm rods 22. Conventional permanent solution is then applied to the hair 20 of the individual 18, and is also applied through the apertures 14 on each of the strips 12. This allows the permanent solution to be evenly applied to all areas of the hair 20. The treatment of the hair 20 of the individual 18 is then continued and concluded according to conventional practice.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. In a permanent hair treatment method comprising the steps of: rolling an individual's hair around a plurality of variously sized color coded cylindrical permanent rods, securing the permanent rods by placing bands on each rod over the hair wound around the rod, the improvement comprising the steps of:

inserting a thin flexible strip of plastic material provided with a row of closely spaced apertures between the hair and band on each permanent rod; and treating the hair with permanent solution applied through the apertures of each strip.

2. The hair treatment method of claim 1, wherein each of said strips have a width of approximately one half inch, a thickness of approximately one thirty second of an inch and various lengths between two and three and one half inches.

3. The hair treatment method of claim 2, further comprising the step of selecting various standard conventional permanent rod sizes from ten different available sizes, color coded from smallest to largest respectively by the colors yellow, blue, pink, grey, white, green, purple, beige, orange and brown; and selecting a correspondingly color coded strip from strips provided in a two inch length color coded yellow, blue and pink; a three inch length color coded grey, white, green and purple; and a three and one half inch length color coded beige, orange and brown.

4. The hair treatment method of claim 1, further comprising the step of selecting a strip having a color coded length corresponding to the color coding of each of the various sized permanent rods.

5. In combination with a conventional elongated permanent rod having an associated hair securement band, means for insertion between said securement band and hair of an individual wound around said permanent rod, said means for insertion comprising:

a thin flexible strip of plastic material;

said strip having a width of approximately one half inch, a thickness of approximately one thirty seconds of an inch and a length between two and three and one half inches;

said strip provided with a row of closely spaced circular apertures;

and said strip having radiused ends.

6. In combination with a set of conventional elongated permanent rods, each having an associated hair securement band, means for insertion between said securement bands and hair of an individual wound around said permanent rods, said means for insertion comprising:

a set of thin flexible strips, each formed from a plastic material;

said strips each having a width of approximately one half inch, a thickness of approximately one thirty second of an inch and a length between two and three and one half inches;

said strips each provided with a row of closely spaced circular apertures;

and said strips each having radiused ends.

7. The combination of claim 6, wherein said set of permanent rods includes rods of various different lengths, each color coded according to length, and said set of strips includes a plurality of strips of different length, each different length of strip color coded in correspondence with the color coding of the conventional permanent rods.

8. The hair treatment device of claim 7, wherein said set of permanent rods include rods of ten different sizes, color coded from smallest to largest respectively by the colors yellow, blue, pink, grey, white, green, purple, beige, orange and brown; and said set of strips includes strips provided in a two inch length color coded yellow, blue and pink; a three inch length color coded grey, white, green and purple; and a three and one half inch length color coded beige, orange and brown.

* * * * *